US009997844B2

(12) United States Patent
Lilja

(10) Patent No.: US 9,997,844 B2
(45) Date of Patent: Jun. 12, 2018

(54) CONTACTLESS MILLIMETER WAVE COUPLER, AN ELECTRONIC APPARATUS AND A CONNECTOR CABLE

(71) Applicant: Microsoft Technology Licensing, LLC, Redmond, WA (US)

(72) Inventor: Juha Lilja, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 120 days.

(21) Appl. No.: 15/236,832

(22) Filed: Aug. 15, 2016

(65) Prior Publication Data

US 2018/0048074 A1 Feb. 15, 2018

(51) Int. Cl.

| | |
|---|---|
| ***H01Q 21/24*** | (2006.01) |
| ***H01Q 21/26*** | (2006.01) |
| ***H01Q 1/50*** | (2006.01) |
| ***H01Q 9/06*** | (2006.01) |
| ***H01Q 1/24*** | (2006.01) |

(52) U.S. Cl.

CPC ..... *H01Q 21/24* (2013.01); *H01Q 1/24* (2013.01); *H01Q 1/50* (2013.01); *H01Q 9/065* (2013.01)

(58) Field of Classification Search

CPC .. H01Q 1/12; H01Q 1/24; H01Q 1/50; H01Q 9/065; H01Q 21/24; H01Q 21/26; H01Q 21/28; H01Q 5/40

See application file for complete search history.

(56) References Cited

U.S. PATENT DOCUMENTS 3,775,771 A * 11/1973 Scherer ..... H01Q 21/0043 343/770
3,971,032 A * 7/1976 Munson ..... H01Q 9/0421 343/770
4,783,661 A * 11/1988 Smith ..... H01Q 9/0407 343/700 MS
5,412,351 A 5/1995 Nystrom et al.

(Continued)

FOREIGN PATENT DOCUMENTS

WO 2013091920 A1 6/2013
WO 2014076635 A1 5/2014

(Continued)

OTHER PUBLICATIONS

Gabriel, Caroline, "Huawei uses stadium play to showcase future networks", Published on: Aug. 11, 2014, 6 pages, Available at: http://www.wi-fi360.com/huawei-uses-stadium-play-showcase-future-networks/.

(Continued)

*Primary Examiner* — Tho G Phan

(57) ABSTRACT

In one example, a contactless millimeter wave coupler comprises a metallic plate. The contactless millimeter wave coupler further comprises a crossed slot arranged in the metallic plate. The contactless millimeter wave coupler further comprises an antenna arrangement mounted beneath the crossed slot. The antenna arrangement comprises a first linearly polarized antenna and a second linearly polarized antenna arranged in a cross configuration relative to each other. The contactless millimeter wave coupler further comprises a wave guiding layer of dielectric material arranged above the antenna arrangement in alignment with the crossed slot and the antenna arrangement.

20 Claims, 6 Drawing Sheets

(56) References Cited

U.S. PATENT DOCUMENTS

| | | | | |
|---|---|---|---|---|
| 6,642,898 | B2 * | 11/2003 | Eason | H01Q 1/38 343/767 |
| 6,911,952 | B2 * | 6/2005 | Sievenpiper | H01Q 13/10 343/767 |
| 8,629,812 | B2 * | 1/2014 | Jaffri | H01Q 13/18 343/767 |
| 8,737,190 | B2 | 5/2014 | Yong et al. | |
| 8,970,435 | B2 | 3/2015 | Aboush | |
| 9,107,027 | B2 | 8/2015 | Sudak | |
| 9,118,990 | B2 | 8/2015 | Hankey et al. | |
| 9,191,263 | B2 | 11/2015 | McCormack et al. | |
| 9,226,092 | B2 | 12/2015 | Moshfeghi | |
| 2015/0194724 | A1 | 7/2015 | Yepes et al. | |

FOREIGN PATENT DOCUMENTS

| | | | |
|---|---|---|---|
| WO | 2014193475 | A1 | 12/2014 |
| WO | 2015149274 | A1 | 10/2015 |

OTHER PUBLICATIONS

Gao, et al., "Circularly Polarized Antennas", In Publication of Wiley-IEEE Press, Feb. 3, 2014, 26 pages.

* cited by examiner

400

CONTACTLESS MILLIMETER WAVE COUPLER, AN ELECTRONIC APPARATUS AND A CONNECTOR CABLE

BACKGROUND

High bandwidth applications are becoming increasingly common in various electronic devices, including mobile communication devices and virtual reality devices. In addition, these electronic devices may utilize various accessories that also require high bandwidth data transfer to and from their respective host devices. Providing such high bandwidth data transfer over connectors may be difficult, particularly when the connector needs to be contactless.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one example, a contactless millimeter wave coupler comprises a metallic plate. The contactless millimeter wave coupler further comprises a crossed slot arranged in the metallic plate. The contactless millimeter wave coupler further comprises an antenna arrangement mounted beneath the crossed slot. The antenna arrangement comprises a first linearly polarized antenna and a second linearly polarized antenna arranged in a cross configuration relative to each other. The contactless millimeter wave coupler further comprises a wave guiding layer of dielectric material that is arranged above the antenna arrangement in alignment with the crossed slot and the antenna arrangement.

In another example, an electronic apparatus and a connector cable have been discussed along with the features of the contactless millimeter wave coupler.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of operations for constructing and operating the example. However, the same or equivalent functions and sequences may be accomplished by different examples.

At least some of the disclosed examples may allow enhanced high bandwidth data transfer by enabling two simultaneous data transmissions (one for each of the linearly polarized antennas that are orthogonal to each other) that do not interfere with each other. At least some of the disclosed examples may allow enhanced high bandwidth data transfer independent of rotation of two connected couplers with respect to each other by enabling circular polarization.

Figure 1:
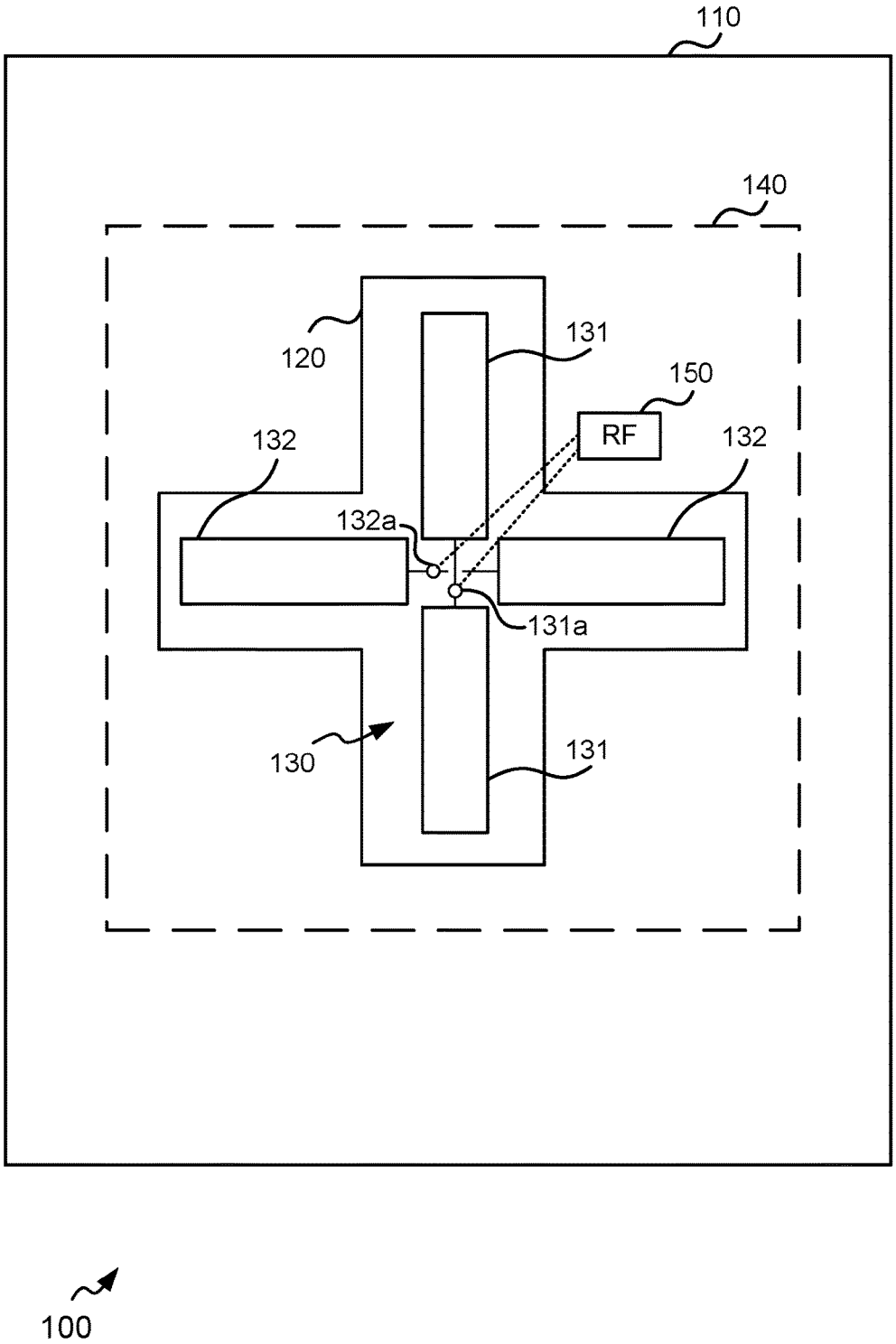
FIG. 1 is an example top view of a contactless millimeter wave coupler in accordance with an example embodiment.

FIG. 1 illustrates a contactless millimeter wave coupler 100 in accordance with an example embodiment. The contactless millimeter wave coupler 100 may be employed, for example, in the electronic apparatus 310 and/or the connector cable 320 of FIGS. 3A-3C. The electronic apparatus 310 may be employed, for example, in the electronic device 400 of FIG. 4. However, it should be noted that the contactless millimeter wave coupler 100 may also be employed on a variety of other devices and apparatuses, and therefore, embodiments should not be limited to application on devices and apparatuses such as the electronic apparatus 310, the connector cable 320 and the electronic device 400. Furthermore, it should be noted that at least some of the elements described below may not be mandatory and thus some may be omitted in certain embodiments. The electronic apparatus 310 may include e.g. mobile communication devices (such as smart phones, tablet computers, and the like), digital cameras, virtual reality (VR) devices, augmented reality (AR) devices, and the like.

The contactless millimeter wave coupler 100 may include e.g. a contactless wireless gigabit (WiGig) coupler. WiGig is specified in IEEE (Institute of Electrical and Electronics Engineers) 802.11ad specification. WiGig operates in the 60 GHz (gigahertz) millimeter wave spectrum. The peak transmission rate of WiGig is 7 Gbit/s (gigabits per second).

The contactless millimeter wave coupler 100 comprises a metallic plate or sheet 110. The metallic plate 110 may form a part of the surface structure of the contactless millimeter wave coupler 100. Alternatively, the metallic plate 110 may form a part of a housing of a host device, and the antenna arrangement 130 mounted beneath the crossed slot 120 may further be mounted inside the housing. Examples of such a host device are the electronic apparatus 310 and the connector cable 320 of FIGS. 3A-3C.

The contactless millimeter wave coupler 100 further comprises a crossed slot 120 that is arranged in the metallic plate 110. Herein, the term "crossed" indicates "cross shaped" or "in the shape of a cross or X". The cross shape may be symmetric or asymmetric. Herein, the term "slot" indicates a through-hole in the metallic plate 110. At least in some of the disclosed examples the crossed slot 120 may enhance polarization purity of the cross-polarized antenna arrangement 130. In other words, the crossed slot 120 may function as a filter that prevents the two linearly polarized antennas of the cross-polarized antenna arrangement from coupling with each other.

The contactless millimeter wave coupler 100 further comprises an antenna arrangement 130 that is mounted beneath the crossed slot 120. The antenna arrangement 130 comprises a first linearly polarized antenna 131 and a second linearly polarized antenna 132 that are arranged in a cross configuration relative to each other. The first linearly polarized antenna 131 and the second linearly polarized antenna 132 arranged in the cross configuration relative to each other may be further arranged substantially orthogonally with respect to each other. Here, "substantially" indicates a variance of ±10 degrees. Again, the term "cross" indicates "cross shaped" or "in the shape of a cross or X". The cross shape may be symmetric or asymmetric.

In an embodiment, the first linearly polarized antenna 131 may comprise a first dipole antenna, and the second linearly polarized antenna 132 may comprise a second dipole antenna.

In an embodiment, the crossed slot 120 and the cross configuration of the antenna arrangement 130 may be substantially parallel to each other, as shown in the example of FIG. 1. Alternatively, an angular displacement between the crossed slot and the cross configuration of the antenna arrangement may be at least 45 degrees and no more than substantially 90 degrees. Furthermore, the dimensions (length and width) of the crossed slot 120 may be larger than the corresponding dimensions of the antenna arrangement 130. Alternatively, the dimensions (length and width) of the crossed slot 120 may be smaller than the corresponding dimensions of the antenna arrangement 130. Alternatively, the dimensions (length and width) of the crossed slot 120 may be equal to the corresponding dimensions of the antenna arrangement 130.

The contactless millimeter wave coupler 100 further comprises a wave guiding layer 140 of dielectric material that is arranged above the antenna arrangement 130 in alignment with the crossed slot 120 and the antenna arrangement 130. The wave guiding layer 140 of dielectric material may be further arranged inside the crossed slot 120 and/or above the crossed slot 120. The dielectric material of the wave guiding layer 140 may comprise e.g. plastics, glass, ceramics, or printed circuit board (PCB) dielectrics. In an embodiment, the material of the wave guiding layer 140 may be magnetic in addition to being dielectric. At least in some of the disclosed examples the wave guiding layer 140 of dielectric material may allow effectively drawing the electromagnetic energy from the sides of the antennas, and effectively guiding the electromagnetic energy from the contactless millimeter wave coupler to its counterpart (i.e. to another contactless millimeter wave coupler). That is, the wave guiding layer 140 of dielectric material may allow a tunnel which binds electromagnetic energy such that it can be guided from the contactless millimeter wave coupler to its counterpart. To enable this, the relative permittivity or permeability of the wave guiding layer 140 of dielectric material may be selected to be larger than with the materials around it. Use of magnetic material in the wave guiding layer 140 may allow docking and/or locking two devices equipped with the contactless millimeter wave coupler (such as the electronic apparatus 310 and the connector cable 320 of FIGS. 3A-3C) to each other. Alternatively/additionally, magnetic material may be used elsewhere, e.g. in additional layers 160 of FIG. 2D.

The dimensions of the antenna arrangement 130 may depend at least on the frequency band to be used. E.g. for the 60 GHz millimeter wave spectrum of WiGig, the length of each dipole antenna may be 1.6 mm (millimeters). The dimensions of the wave guiding layer 140 of dielectric material may depend at least on its relative permittivity of $\in_r$. For example, for $\in_r=10$, the length and/or width of the wave guiding layer 140 of dielectric material may be 0.7 mm, and the thickness of the wave guiding layer 140 of dielectric material may be 0.25 mm. In other embodiments, $\in_r$ larger than 4 may be used, for example. Furthermore, in an embodiment, the dimensions of the wave guiding layer 140 of dielectric material may not be substantially larger than those of the antenna arrangement 130 and/or the crossed slot 120 in order to prevent the electromagnetic energy from spreading too wide in a sideways direction. In other words and as discussed above, the wave guiding layer 140 of dielectric material is intended to function as a guiding tunnel.

Figure 2A:
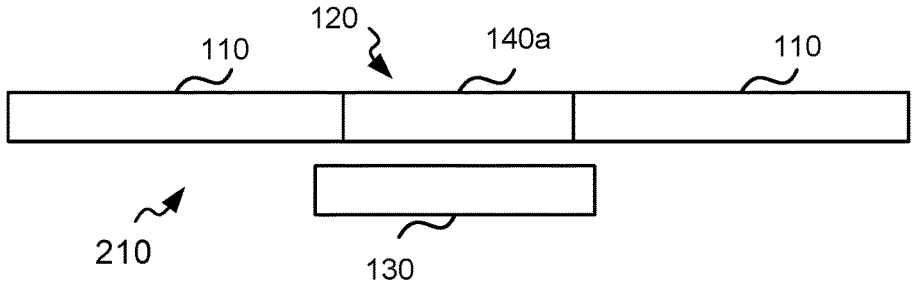
FIGS. 2A-2D are example side views of a contactless millimeter wave coupler in accordance with an example embodiment.
Figure 2B:
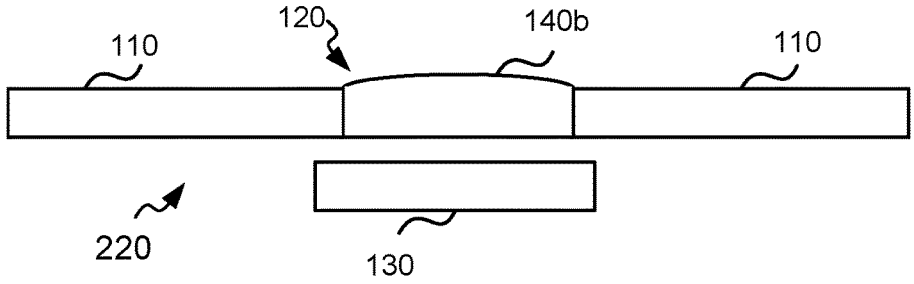
Figure 2C:
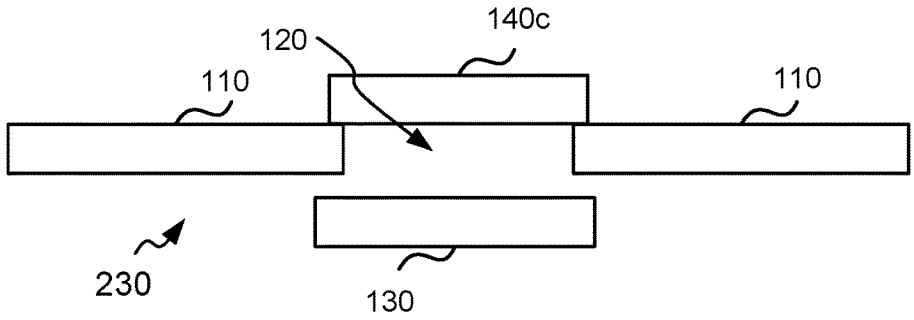
Figure 2D:
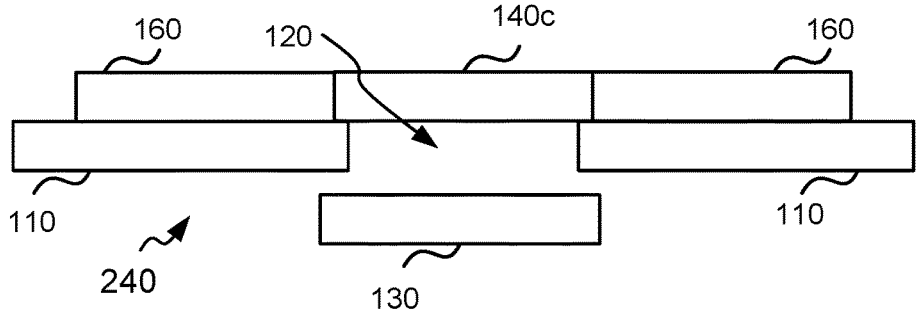

FIGS. 2A-2D are example side views of a contactless millimeter wave coupler in accordance with an example embodiment. FIG. 2A illustrates an embodiment in which the wave guiding layer 140*a* of dielectric material is arranged inside the crossed slot 120 and level with the upper surface of the metallic plate 110. FIG. 2B illustrates an embodiment in which the wave guiding layer 140*b* of dielectric material is arranged inside the crossed slot 120 and above the upper surface of the metallic plate 110. FIG. 2C illustrates an embodiment in which the wave guiding layer 140*c* of dielectric material is arranged outside the crossed slot 120 and above the upper surface of the metallic plate 110. FIG. 2D illustrates an embodiment in which the wave guiding layer 140*c* of dielectric material is also arranged outside the crossed slot 120 and above the upper surface of the metallic plate 110, but the layer 140*c* is embedded in or surrounded by an additional layer 160, such as a layer of plastics covering the metallic plate 110. Accordingly, the wave guiding layer 140 of dielectric material may be e.g. molded or hidden inside a chassis or the like.

The contactless millimeter wave coupler 100 may further comprise a radio frequency divider circuitry 150 that is connected to a feed port 131*a* of the first linearly polarized antenna 131 and to a feed port 132*a* of the second linearly polarized antenna 132. The radio frequency divider circuitry 150 is configured to divide a first data stream associated with the first linearly polarized antenna 131 into two substantially orthogonal first parts, i.e. two parts with a 90 degree phase difference. Furthermore, the radio frequency divider circuitry 150 is configured to divide a second data stream associated with the second linearly polarized antenna 132 into two substantially orthogonal second parts, i.e. two parts with a 90 degree phase difference. Here, "substantially" indicates a variance of ±10 degrees.

Dividing each of the two data streams into two orthogonal parts or branches allows for dual circular polarization (one instance of right handed circular polarization and one instance of left handed circular polarization) which in turn allows independent rotation of two connected couplers with respect to each other. That is, the two connected couplers tolerate rotation with respect to each other, i.e. such rotation does not deteriorate data transfer rates.

The radio frequency divider circuitry 150 may comprise a 90 degree hybrid coupler (also known as a quadrature coupler). The 90 degree hybrid coupler may comprise a branch line coupler.

Figure 3A:
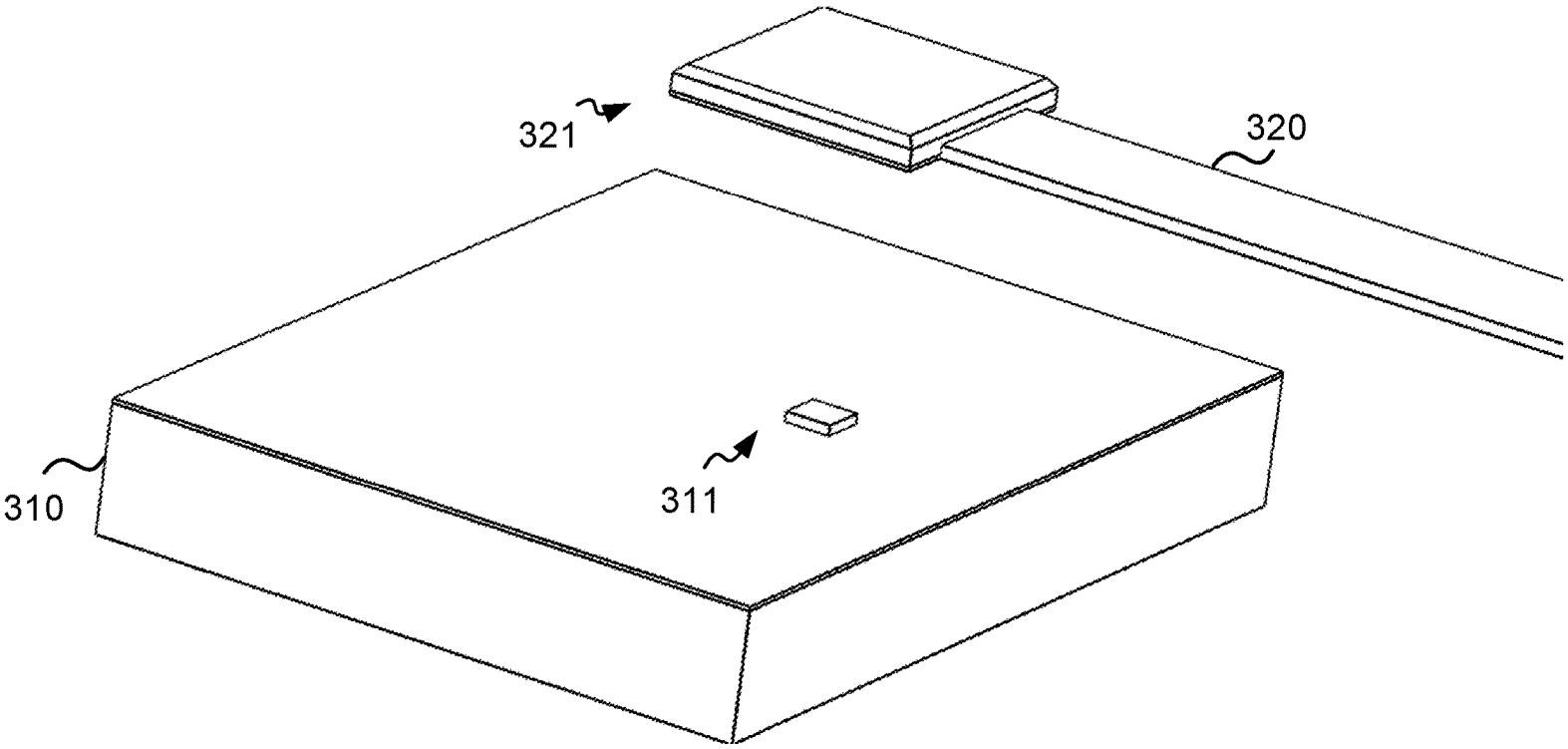
FIGS. 3A-3C are example views of an electronic apparatus with a contactless millimeter wave coupler and a connector cable with a similar contactless millimeter wave coupler in accordance with an example embodiment.
Figure 3B:
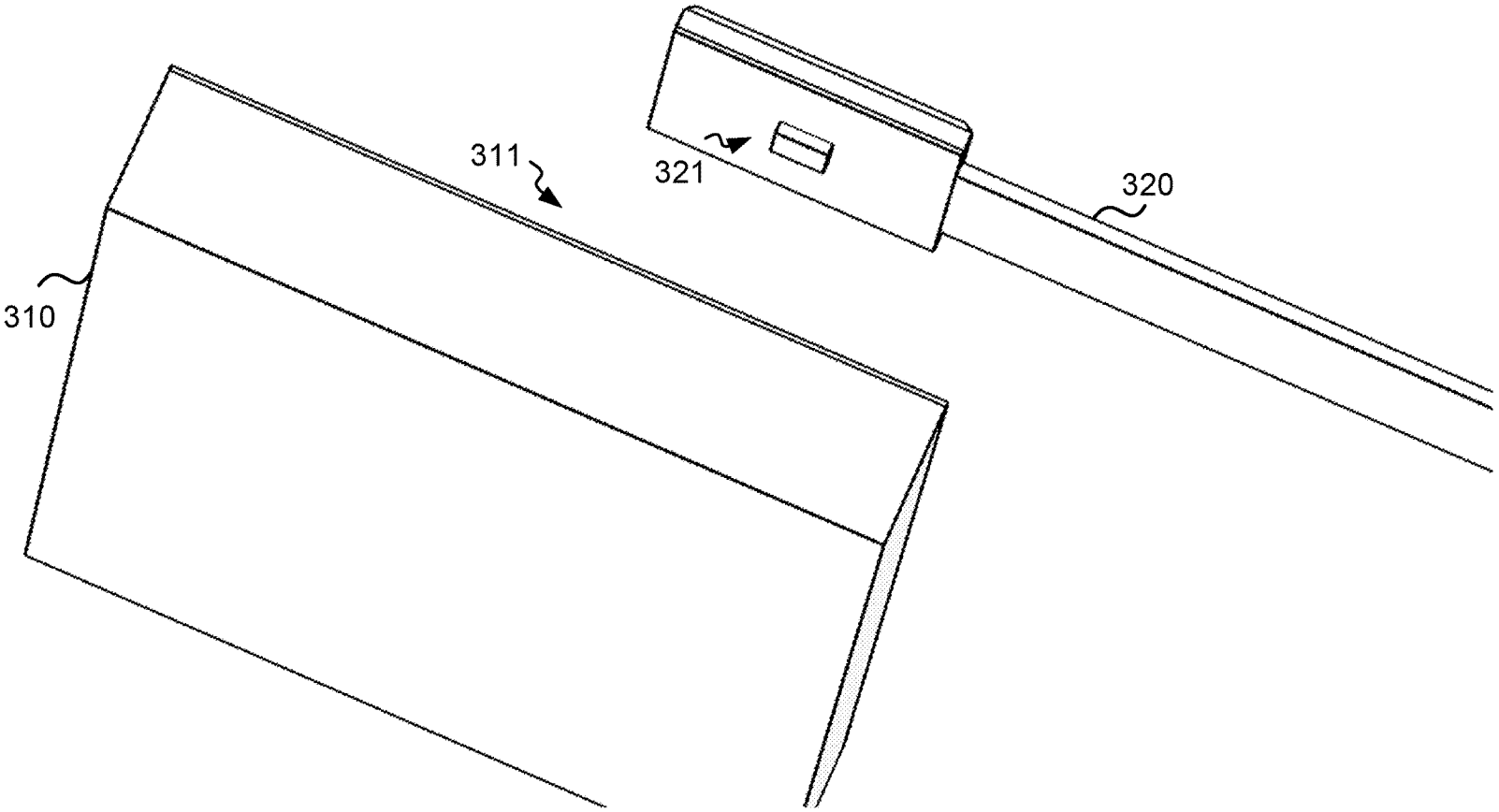
Figure 3C:
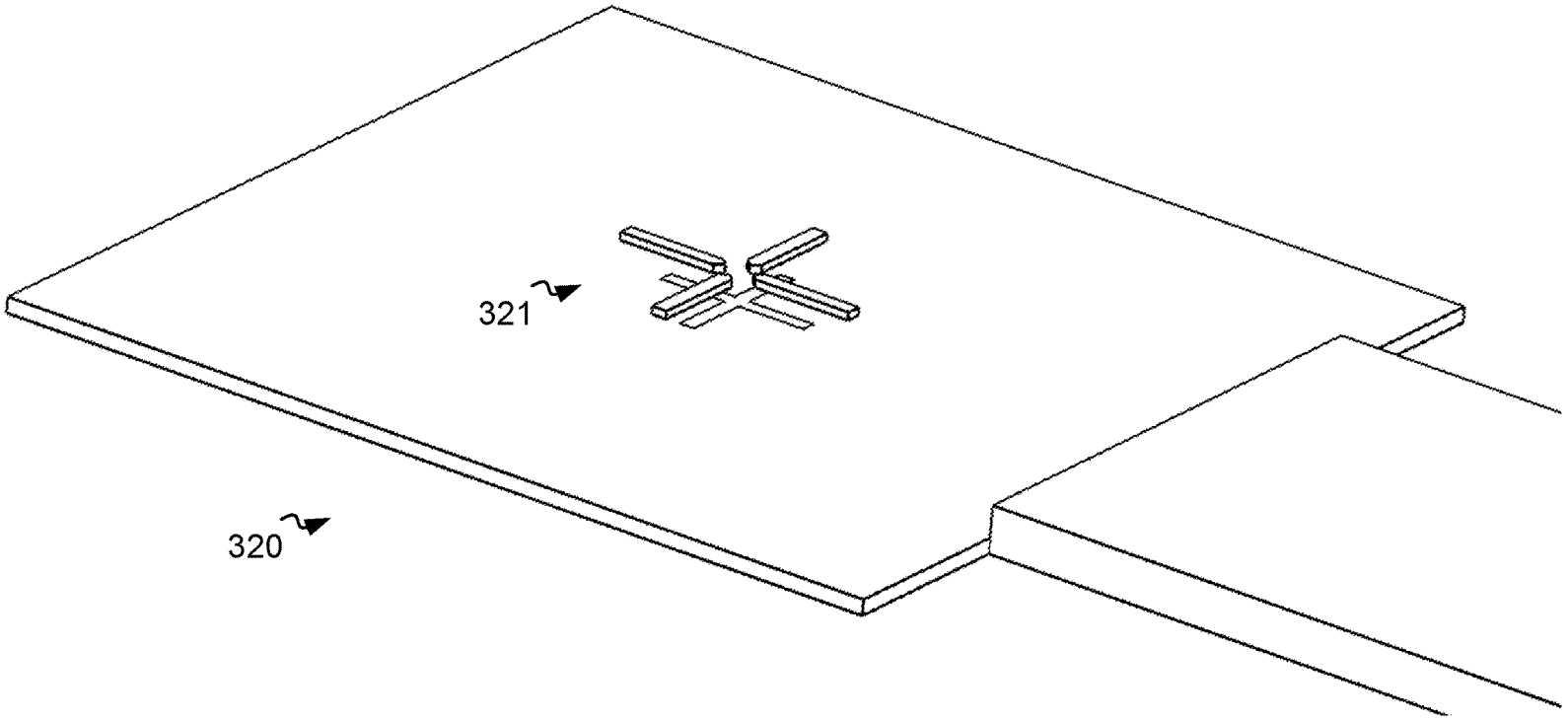

FIGS. 3A-3C are example views of an electronic apparatus 310 with a contactless millimeter wave coupler 311 and a connector cable 320 with a similar contactless millimeter wave coupler 321. FIG. 3A illustrates the contactless millimeter wave coupler 311 and the connector cable 320 seen from above. FIG. 3B illustrates the contactless millimeter wave coupler 311 and the connector cable 320 seen from below. FIG. 3C illustrates a close-up of the connector cable 320 with the crossed slot and the antenna arrangement visible. The invention allows a distance of at least half a meter between two contactless millimeter wave couplers without data transfer between them being disconnected. At least some of the disclosed examples may allow implementing the contactless millimeter wave coupler inside an end of a connector cable itself.

Figure 4:
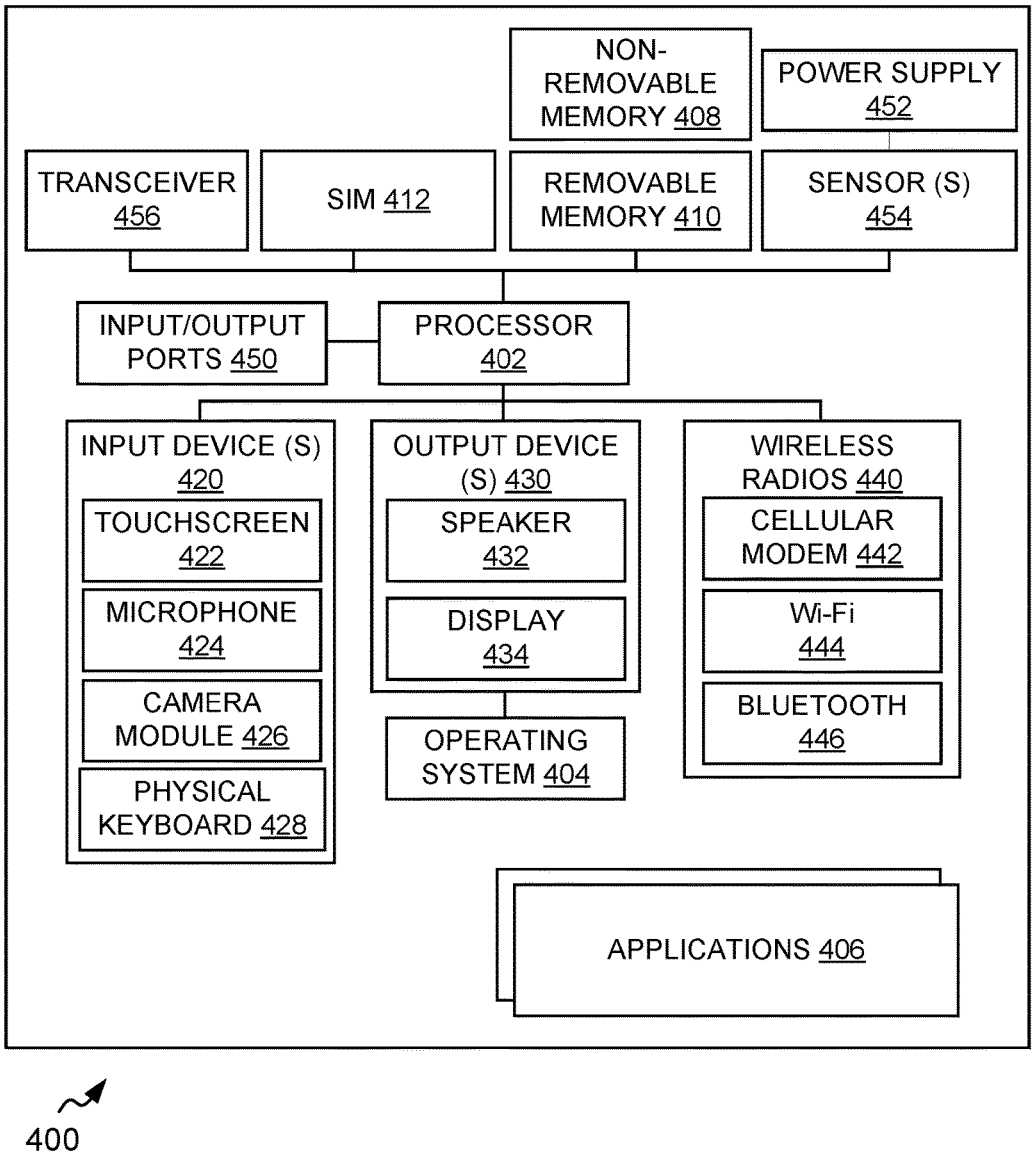
FIG. 4 illustrates an example block diagram of an electronic device capable of implementing example embodiments described herein.

FIG. 4 is a schematic block diagram of an electronic device 400 capable of implementing embodiments of the techniques described herein. It should be understood that the electronic device 400 as illustrated and hereinafter described is merely illustrative of one type of apparatus or an electronic device and should not be taken to limit the scope of the embodiments. As such, it should be appreciated that at least some of the components described below in connection with the electronic device 400 may be optional and thus in an example embodiment may include more, less or different components than those described in connection with the example embodiment of FIG. 4. As such, among other examples, the electronic device 400 could be any of apparatuses incorporating a digital display panel with an internal frame buffer. For example, the electronic device 400 may be implemented as a stand-alone digital camera device, or the electronic device 400 may be implemented e.g. as a smartphone, a tablet computer, or a virtual reality device.

The illustrated electronic device 400 includes a controller or a processor 402 (i.e. a signal processor, microprocessor, ASIC, or other control and processing logic circuitry) for performing such tasks as signal coding, data processing, input/output processing, power control, and/or other functions. An operating system 404 controls the allocation and usage of the components of the electronic device 400 and support for one or more application programs 406. The application programs 406 can include common mobile applications, for instance, telephony applications, email applications, calendars, contact managers, web browsers, messaging applications, or any other application.

The illustrated electronic device 400 includes one or more memory components, for example, a non-removable memory 408 and/or removable memory 410. The non-removable memory 408 may include RAM, ROM, flash memory, a hard disk, or other well-known memory storage technologies. The removable memory 410 may include flash memory or smart cards. The one or more memory components may be used for storing data and/or code for running the operating system 404 and the applications 406. Example of data may include web pages, text, images, sound files, image data, video data, or other data sets to be sent to and/or received from one or more network servers or other devices via one or more wired or wireless networks. The electronic device 400 may further include a subscriber identity module (SIM) 412. The SIM 412 typically stores information elements related to a mobile subscriber. A SIM is well known in Global System for Mobile Communications (GSM) communication systems, Code Division Multiple Access (CDMA) systems, or with third-generation (3G) wireless communication protocols such as Universal Mobile Telecommunications System (UMTS), CDMA1000, wideband CDMA (WCDMA) and time division-synchronous CDMA (TD-SCDMA), or with fourth-generation (4G) wireless communication protocols such as LTE (Long-Term Evolution). The SIM 412 may comprise a virtual SIM. Furthermore, multiple SIMs may be utilized.

The electronic device 400 can support one or more input devices 420 and one or more output devices 430. Examples of the input devices 420 may include, but are not limited to, a touchscreen 422 (i.e., capable of capturing finger tap inputs, finger gesture inputs, multi-finger tap inputs, multi-finger gesture inputs, or keystroke inputs from a virtual keyboard or keypad), a microphone 424 (i.e., capable of capturing voice input), a camera module 426 (i.e., capable of capturing still picture images and/or video images) and a physical keyboard 428. Examples of the output devices 430 may include, but are not limited to a speaker 432 and a display 434. Other possible output devices (not shown) can include piezoelectric or other haptic output devices. Some devices can serve more than one input/output function. For example, the touchscreen 422 and the display 434 can be combined into a single input/output device.

In an embodiment, the electronic device 400 may comprise a wireless radio(s) 440. The wireless radio(s) 440 can support two-way communications between the processor 402 and external devices, as is well understood in the art. The wireless radio(s) 440 are shown generically and can include, for example, a cellular modem 442 for communicating at long range with the mobile communication network, a Wi-Fi radio 444 for communicating at short range with a local wireless data network or router, and/or a BLUETOOTH radio 446. The cellular modem 442 is typically configured for communication with one or more cellular networks, such as a GSM/3G/4G network for data and voice communications within a single cellular network, between cellular networks, or between the mobile device and a public switched telephone network (PSTN).

The electronic device 400 can further include one or more input/output ports 450, a power supply 452, one or more sensors 454, for example an accelerometer, a gyroscope, a compass, or an infrared proximity sensor for detecting the orientation or motion of the electronic device 400, and a transceiver 456 (for wirelessly transmitting analog or digital signals). The input/output ports 450 may include or be connected to the contactless millimeter wave coupler 100 of FIG. 1. The illustrated components are not required or all-inclusive, as any of the components shown can be deleted and other components can be added.

At least some of the examples disclosed in FIGS. 1-4 are able to provide enhanced high bandwidth data transfer by enabling two simultaneous data transmissions (one for each of the linearly polarized antennas that are orthogonal to each other) that do not interfere with each other. At least some of the examples disclosed in FIGS. 1-4 are able to provide enhanced high bandwidth data transfer independent of rotation of two connected couplers with respect to each other by enabling circular polarization. At least some of the examples disclosed in FIGS. 1-4 are able to provide a contactless millimeter wave coupler of very small dimensions (e.g. the antenna arrangement and the crossed slot may be less than two millimeters in width and length in some embodiments) thus allowing a wide variety of applications.

An embodiment of a contactless millimeter wave coupler comprises a metallic plate; a crossed slot arranged in the metallic plate; an antenna arrangement mounted beneath the crossed slot, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

In an embodiment, alternatively or in addition to the above described embodiments, the contactless millimeter wave coupler further comprises a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

In an embodiment, alternatively or in addition to the above described embodiments, the radio frequency divider circuitry comprises a 90 degree hybrid coupler.

In an embodiment, alternatively or in addition to the above described embodiments, the 90 degree hybrid coupler comprises a branch line coupler.

In an embodiment, alternatively or in addition to the above described embodiments, the wave guiding layer of dielectric material is further arranged at least one of: inside the crossed slot or above the crossed slot.

In an embodiment, alternatively or in addition to the above described embodiments, the crossed slot and the cross configuration of the antenna arrangement are substantially parallel to each other.

In an embodiment, alternatively or in addition to the above described embodiments, an angular displacement between the crossed slot and the cross configuration of the antenna arrangement is at least 45 degrees and no more than substantially 90 degrees.

In an embodiment, alternatively or in addition to the above described embodiments, the first linearly polarized antenna and the second linearly polarized antenna arranged in the cross configuration relative to each other are further arranged substantially orthogonally with respect to each other.

In an embodiment, alternatively or in addition to the above described embodiments, dimensions of the crossed slot are larger than, smaller than, or equal to corresponding dimensions of the antenna arrangement.

In an embodiment, alternatively or in addition to the above described embodiments, the first linearly polarized antenna comprises a first dipole antenna, and the second linearly polarized antenna comprises a second dipole antenna.

In an embodiment, alternatively or in addition to the above described embodiments, the metallic plate forms a part of a surface structure of the contactless millimeter wave coupler.

In an embodiment, alternatively or in addition to the above described embodiments, the metallic plate forms a part of a housing of a host device, and the antenna arrangement mounted beneath the crossed slot is further mounted inside the housing.

In an embodiment, alternatively or in addition to the above described embodiments, the dielectric material of the wave guiding layer is additionally of magnetic material.

In an embodiment, alternatively or in addition to the above described embodiments, the dielectric material of the wave guiding layer comprises plastics, glass, ceramics, or printed circuit board (PCB) dielectrics.

In an embodiment, alternatively or in addition to the above described embodiments, the contactless millimeter wave coupler comprises a contactless wireless gigabit (Wi-Gig) coupler.

An embodiment of an electronic apparatus comprises a housing comprising a metallic plate; a crossed slot arranged in the metallic plate; an antenna arrangement mounted beneath the crossed slot inside the housing, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

In an embodiment, alternatively or in addition to the above described embodiments, the electronic apparatus further comprises a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

In an embodiment, alternatively or in addition to the above described embodiments, the electronic apparatus further comprises at least one of a mobile communication device, a tablet computer, a digital camera, or a virtual reality device.

An embodiment of a connector cable comprises a metallic plate arranged at an end of the connector cable; a crossed slot arranged in the metallic plate; an antenna arrangement mounted beneath the crossed slot inside the housing, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

In an embodiment, alternatively or in addition to the above described embodiments, further comprising a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

The embodiments illustrated and described herein as well as embodiments not specifically described herein but within the scope of aspects of the claims constitute exemplary means for preventing two linearly polarized antennas from coupling with each other, for transmitting and/or receiving data, and for guiding electromagnetic energy. For example, the metallic plate and the crossed slot arranged in the metallic plate constitute exemplary means for preventing two linearly polarized antennas from coupling with each other, when arranged above the antenna arrangement. As another example, the antenna arrangement constitutes exemplary means for transmitting and/or receiving data, when mounted beneath the crossed slot and comprising a first linearly polarized antenna and a second linearly polarized antenna arranged in a cross configuration relative to each other. As yet another example, the wave guiding layer of dielectric material constitutes exemplary means for guiding electromagnetic energy, when arranged above the antenna arrangement in alignment with the crossed slot and the antenna arrangement.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include mobile telephones (including smart phones), tablet computers and many other devices.

The processes described herein may be performed by software in machine readable form on a tangible storage medium e.g. in the form of a computer program comprising computer program code means adapted to perform all the steps of any of the processes described herein when the program is run on a computer and where the computer program may be embodied on a computer readable medium. Examples of tangible storage media include disks, thumb drives, memory etc. and do not include propagated signals. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a digital signal processor (DSP), programmable logic array, or the like.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and the like.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims, and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

Aspects of any of the examples described above may be combined with aspects of any of the other examples described to form further examples without losing the effect sought.

The term 'comprising' is used herein to mean including the blocks or elements identified, but that such blocks or elements do not comprise an exclusive list, and a system, a device or an apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example, may be connected in any combination to any other example also.

The invention claimed is:

1. A contactless millimeter wave coupler, comprising:

a metallic plate;

a crossed slot arranged in the metallic plate;

an antenna arrangement mounted beneath the crossed slot, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

2. The contactless millimeter wave coupler as claimed in claim 1, further comprising a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

3. The contactless millimeter wave coupler as claimed in claim 2, wherein the radio frequency divider circuitry comprises a 90 degree hybrid coupler.

4. The contactless millimeter wave coupler as claimed in claim 3, wherein the 90 degree hybrid coupler comprises a branch line coupler.

5. The contactless millimeter wave coupler as claimed in claim 1, wherein the wave guiding layer of dielectric material is further arranged at least one of: inside the crossed slot or above the crossed slot.

6. The contactless millimeter wave coupler as claimed in claim 1, wherein the crossed slot and the cross configuration of the antenna arrangement are substantially parallel to each other.

7. The contactless millimeter wave coupler as claimed in claim 1, wherein an angular displacement between the crossed slot and the cross configuration of the antenna arrangement is at least 45 degrees and no more than substantially 90 degrees.

8. The contactless millimeter wave coupler as claimed in claim 1, wherein the first linearly polarized antenna and the second linearly polarized antenna arranged in the cross configuration relative to each other are further arranged substantially orthogonally with respect to each other.

9. The contactless millimeter wave coupler as claimed in claim 1, wherein dimensions of the crossed slot are larger than, smaller than, or equal to corresponding dimensions of the antenna arrangement.

10. The contactless millimeter wave coupler as claimed in claim 1, wherein the first linearly polarized antenna comprises a first dipole antenna, and the second linearly polarized antenna comprises a second dipole antenna.

11. The contactless millimeter wave coupler as claimed in claim 1, wherein the metallic plate forms a part of a surface structure of the contactless millimeter wave coupler.

12. The contactless millimeter wave coupler as claimed in claim 1, wherein the metallic plate forms a part of a housing of a host device, and the antenna arrangement mounted beneath the crossed slot is further mounted inside the housing.

13. The contactless millimeter wave coupler as claimed in claim 1, wherein the dielectric material of the wave guiding layer is additionally of magnetic material.

14. The contactless millimeter wave coupler as claimed in claim 1, wherein the dielectric material of the wave guiding layer comprises plastics, glass, ceramics, or printed circuit board (PCB) dielectrics.

15. The contactless millimeter wave coupler as claimed in claim 1, wherein the contactless millimeter wave coupler comprises a contactless wireless gigabit (WiGig) coupler.

16. An electronic apparatus, comprising:

a housing comprising a metallic plate;

a crossed slot arranged in the metallic plate;

an antenna arrangement mounted beneath the crossed slot inside the housing, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

17. The electronic apparatus as claimed in claim 16, further comprising a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

18. The electronic apparatus as claimed in claim 16, wherein the electronic apparatus further comprises at least one of a mobile communication device, a tablet computer, a digital camera, or a virtual reality device.

19. A connector cable, comprising:

a metallic plate arranged at an end of the connector cable;

a crossed slot arranged in the metallic plate;

an antenna arrangement mounted beneath the crossed slot inside the housing, and comprising a first linearly polarized antenna and a second linearly polarized antenna arranged in a cross configuration relative to each other; and a wave guiding layer of dielectric material arranged above the antenna arrangement in alignment with the crossed slot and the antenna arrangement.

20. The connector cable as claimed in claim 19, further comprising a radio frequency divider circuitry connected to a feed port of the first linearly polarized antenna and a feed port of the second linearly polarized antenna, and configured to divide a first data stream associated with the first linearly polarized antenna into two substantially orthogonal first parts and to divide a second data stream associated with the second linearly polarized antenna into two substantially orthogonal second parts.

* * * * *